US011731030B2

(12) United States Patent
Marks et al.

(10) Patent No.: US 11,731,030 B2
(45) Date of Patent: Aug. 22, 2023

(54) RELEASABLE MAGNETIC SKI POLE STRAP SYSTEM

(71) Applicants: Lloyd A. Marks, Westfield, NJ (US); Matthew S. Marks, Westfield, NJ (US)

(72) Inventors: Lloyd A. Marks, Westfield, NJ (US); Matthew S. Marks, Westfield, NJ (US)

( * ) Notice: Subject to any disclaimer, the term of this patent is extended or adjusted under 35 U.S.C. 154(b) by 0 days.

(21) Appl. No.: 17/395,940

(22) Filed: Aug. 6, 2021

(65) Prior Publication Data

US 2022/0258031 A1 Aug. 18, 2022

Related U.S. Application Data

(60) Provisional application No. 63/183,448, filed on May 3, 2021, provisional application No. 63/150,964, filed on Feb. 18, 2021.

(51) Int. Cl.
*A63C 11/22* (2006.01)

(52) U.S. Cl.
CPC ..... *A63C 11/2224* (2020.08); *A63C 11/2228* (2020.08)

(58) Field of Classification Search
CPC ..... A63C 11/2224; A63C 11/2228; A63C 11/227; A63C 11/228
See application file for complete search history.

(56) References Cited

U.S. PATENT DOCUMENTS 2,671,484 A * 3/1954 Clark ..... B25B 23/12 81/125
2,975,497 A * 3/1961 Budreck ..... A44B 15/002 70/459
3,041,697 A * 7/1962 Budreck ..... A44B 15/002 24/303

(Continued)

FOREIGN PATENT DOCUMENTS

CN 113827941 A * 12/2021
EP 3020456 A1 * 5/2016 ..... A45B 9/02

(Continued)

OTHER PUBLICATIONS

Guardian Angel Device Tether; retrieved Sep. 10, 2022; https://www.guardianangeldevices.com/p/safety-device-tether/ (Year: 2020).*

(Continued)

*Primary Examiner* — James A Shriver, II
*Assistant Examiner* — Michael T. Walsh
(74) *Attorney, Agent, or Firm* — Blank Rome LLP

(57) ABSTRACT

Releasable magnetic pole strap systems are disclosed. Embodiments are directed to a releasable magnetic pole strap system including a pole which includes: a proximal end having a distal surface; and a pole attachment device connected to the distal surface of the proximal end of the pole. The system also includes a strap including a strap attachment device which is configured to be releasably attached to the pole attachment device. The distal surface of the proximal end of the pole is at least partially covered by the pole attachment device. Each of the pole attachment device and the strap attachment device includes either a magnet or a non-magnetic ferric material. At least one of the pole attachment device or the strap attachment device includes a magnet.

24 Claims, 8 Drawing Sheets

(56) References Cited

U.S. PATENT DOCUMENTS

| | | | | | |
|---|---|---|---|---|---|
| 3,232,632 | A * | 2/1966 | Lewis | A63C 11/2228 | 2/160 |
| 3,246,907 | A | 4/1966 | Chisholm | | |
| 3,378,273 | A * | 4/1968 | Lewis | A63C 11/222 | 403/328 |
| 3,443,820 | A * | 5/1969 | Baker | A63C 11/2224 | 135/65 |
| 3,995,872 | A * | 12/1976 | Joseph | A63C 11/2224 | 280/822 |
| 4,005,872 | A * | 2/1977 | Rischert | A63C 11/2224 | 280/822 |
| 4,129,312 | A | 12/1978 | Loeffelholz | | |
| 4,139,210 | A | 2/1979 | Allsop et al. | | |
| 4,162,081 | A * | 7/1979 | Joseph | A63C 11/2228 | 24/326 |
| 4,234,202 | A * | 11/1980 | Loffelholz | A63C 11/2228 | 280/820 |
| 4,419,644 | A * | 12/1983 | Baermann | H01F 7/04 | 335/295 |
| 5,092,629 | A * | 3/1992 | Bagneres | A63C 11/2228 | 280/821 |
| 5,110,154 | A * | 5/1992 | Street | A41D 19/0037 | 2/160 |
| 5,123,674 | A | 6/1992 | Bagneres et al. | | |
| 5,312,134 | A | 5/1994 | Goode et al. | | |
| 5,887,282 | A * | 3/1999 | Lenhart | A63C 11/2228 | 2/160 |
| 5,908,206 | A | 6/1999 | Lopresti, Jr. | | |
| 6,643,845 | B2 | 11/2003 | O'Dea et al. | | |
| 8,235,423 | B2 | 8/2012 | Starry | | |
| 8,850,670 | B2 | 10/2014 | Fiedler | | |
| 9,526,974 | B2 | 12/2016 | Bennert et al. | | |
| 2005/0283950 | A1* | 12/2005 | Portelli | E05B 65/0014 | 16/441 |
| 2008/0005826 | A1* | 1/2008 | Lenhart | A63C 11/2224 | 2/160 |
| 2009/0242539 | A1 | 10/2009 | Wassel | | |
| 2009/0253538 | A1 | 10/2009 | True | | |
| 2016/0136507 | A1* | 5/2016 | Bennert | A45B 9/02 | 280/822 |
| 2017/0356551 | A1* | 12/2017 | Ishizaki | F16J 15/43 | |
| 2021/0275896 | A1* | 9/2021 | Bernocchi | A41D 19/0037 | |

FOREIGN PATENT DOCUMENTS

| | | | | | |
|---|---|---|---|---|---|
| EP | 3050603 | A2 | | 8/2016 | |
| FR | 2381537 | A1 | * | 2/1978 | |
| FR | 2634388 | A1 | * | 1/1990 | |
| FR | 3044235 | A1 | | 6/2017 | |
| JP | 2005279220 | A | | 10/2005 | |
| JP | 6728290 | B2 | * | 7/2020 | A61M 16/0683 |
| KR | 200314268 | Y | | 5/2003 | |
| WO | WO-2012104457 | A1 | * | 8/2012 | A63C 11/022 |
| WO | WO 2018/167578 | A1 | | 9/2018 | |

OTHER PUBLICATIONS https://www.backcountry.com/leki-carbon.
https://www.wildsnow.com/13159/scott-s-r-s-pole-strap-release-review/.
https://www.magfit.cloud/en/magnetic-ski-poles/.
https://vimeo.com/310791662.
https://www.kjmagnetics.com/proddetail.asp?prod=RX436DCSPC-BLK.
https://www.amazon.com/gp/product/B083DHP38B/ref=ppx_yo_dt_b_asin_title_o04_s00?ie=UTF8&psc=1.
https://www.kjmagnetics.com/proddetail.asp?prod=RX034DCSPC-BLK.
https://www.amazon.com/gp/product/B07RX18RJR/ref=ppx_yo_dt_b_search_asin_image?ie=UTF8&psc=1.
https://www.homedpot.com/p/One-Tie-8-in-Cable-Ties-Orange-25-Pack-TOT60118/304343221.
https://www.amazon.com/Nite-Ize-Packs-Loop-Gear/dp/B01MTANANR/ref=sr_1_5?dchild=1&keywords=nite-ize+gear+tie&qid=1613594375&s=electronics&sr=1-5.
https://www.amazon.com/gp/product/B07HJ8545T/ref=ppx_yo_dt_b_asin_image_o07_s00?ie=UTF8&psc=1.
https://www.amazon.com/gp/product/B08629SS17/ref=ppx_yo_dt_b_search_asin_title?ie=UTF8&psc=1.
https://www.amazon.com/gp/product/B07HJ8545T/ref=ppx_yo_dt_b_asin_title_o01_s00?ie=UTF8&psc=1.
https://www.amazon.com/gp/product/B08DNM2XD9/ref=ppx_yo_dt_b_search_asin_title?ie=UTF8&psc=1.
https://www.patbase.com/getimg/minestf_translate.asp?Ip=fr_en&url.
https://www.bouldernordlc.com/one-way-diamond-14-mag-pole.html.
https://www.tsloutdoor.com/innovations/st-magnetic-strap-system.html.

* cited by examiner

FIG. 11
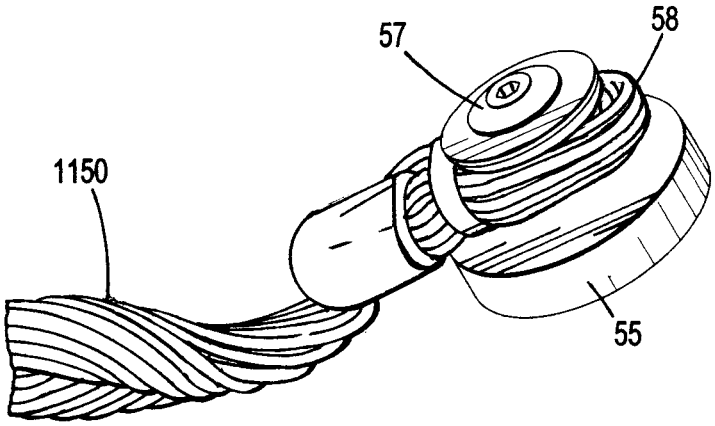
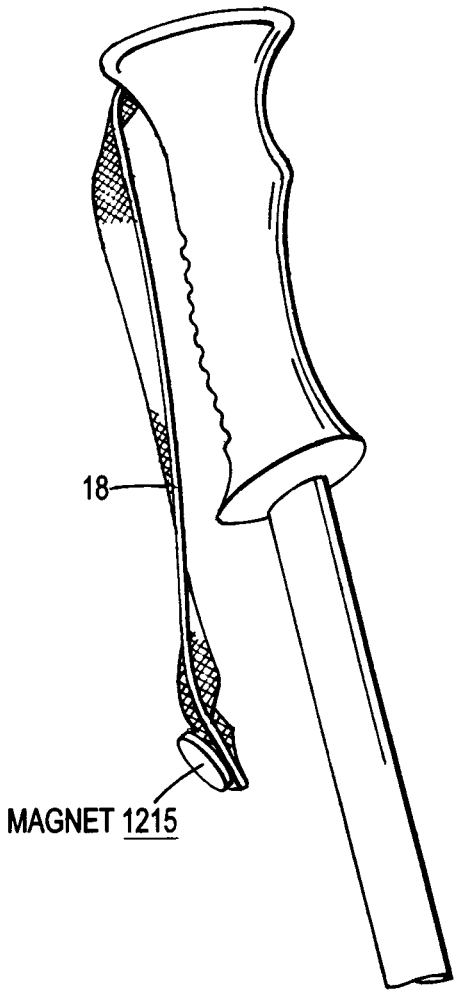
FIG. 12
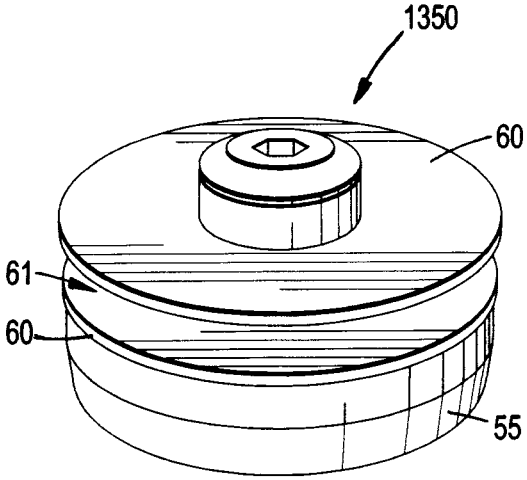
FIG. 13

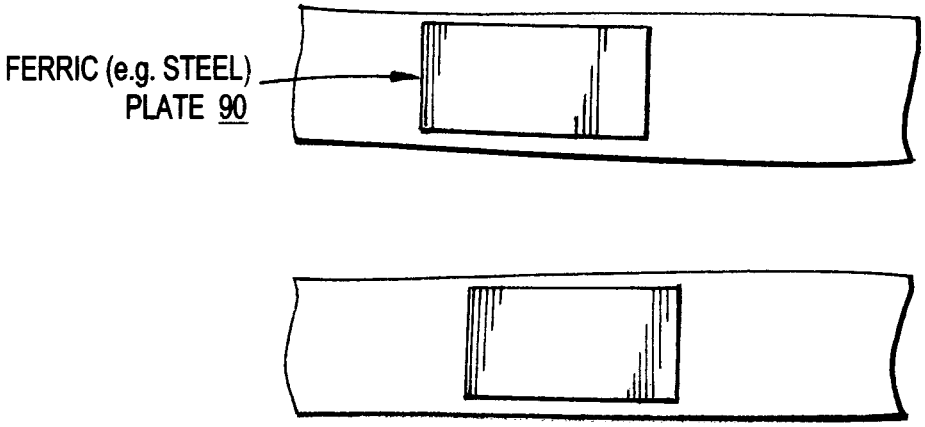
FIG. 19
FIG. 20
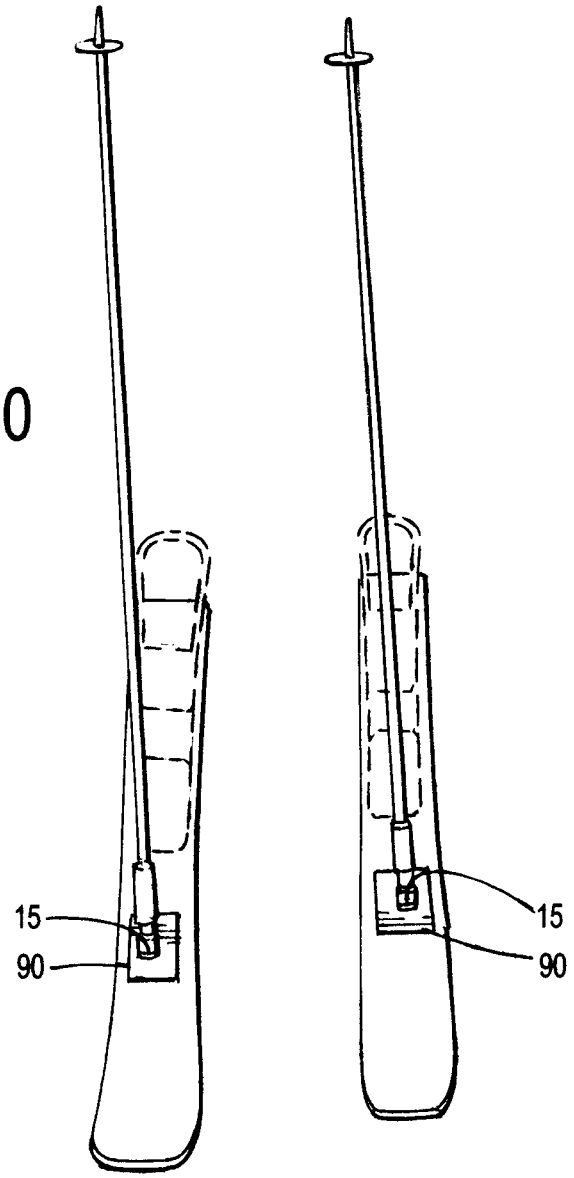

RELEASABLE MAGNETIC SKI POLE STRAP SYSTEM

CROSS REFERENCE TO RELATED APPLICATION(S)

This application claims priority to U.S. Provisional Patent Application Ser. No. 63/150,964, filed on Feb. 18, 2021 and U.S. Provisional Patent Application Ser. No. 63/183,448, filed on May 3, 2021, both of which are hereby incorporated herein by reference in their entireties.

GOVERNMENT SPONSORSHIP

None

FIELD OF THE INVENTION

Embodiments are in the field of ski poles. More particularly, embodiments disclosed herein relate to ski poles, including releasable magnetic straps, which enable a simple, expedient, and secure coupling to a glove.

BACKGROUND OF THE INVENTION

Ski pole straps serve a number of functions. They prevent a skier from losing their poles when they fall, ski pole planting is part of proper ski turn form, and, if worn properly, force can be directed downward on the strap when using the poles to increase speed on flat terrain.

To be worn properly, the right pole strap must be placed on the right hand and the left pole strap must be placed on the left hand. Each hand can be placed two ways through each strap, only one of which is correct. Straps are generally attached to the poles with a screw that passes through the top of the pole and through a grommet in the strap.

Attempts have been made to make releasable ski poles straps. One attempt, Leki at the website www.leki.com, uses a trigger release. That allows a skier, if they are skiing aggressively in the woods, to release their pole if it is trapped in tree branches to avert a hyperextension injury or a condition called "skier's thumb" which is an injury to the ulnar collateral ligament. There is also a passive pole strap release system which appears to use friction to hold the straps in place unless there is a serious fall. The company, Magfit, uses magnets to attach a skier's hand to a pole. In this device, there does not appear to be a way for a skier to apply downward pressure from the base of the thumb for poling on flat surfaces, which the present invention described below provides. It appears that if the Magfit device has a very strong magnetic connection it might facilitate poling on flat terrain but would then require an active release button of some sort. If it has a weak magnetic connection, then the force needed to pole on flat terrain from the base of the thumb could not be generated and the skier would have to rely solely on the hand gripping the pole handle. Both goals could not be achieved with the Magfit device.

Because there are four ways you can put on your first ski pole strap and two ways you can put on the second ski pole strap (resulting in 8 possibilities), only one combination of which is correct, and because ski gloves and mittens tend to be bulky, skiers frequently have trouble getting their poles on and off respectively when they get off or on a chair lift (or other transport mechanism for being carried up the mountain). Therefore, it would clearly be desirable for the straps to remain with the gloves and be removable from the poles easily and reversibly. It would also be desirable for there to be no incorrect way to attach the ski pole straps to the ski poles. Furthermore, it would be desirable for ski poles to be released passively during a serious fall to prevent hyperextension injuries, a change in direction of the skier which may lead to a collision with a tree and/or skier's thumb (rupture of the ulnar collateral ligament), but to remain with the skier during less intense falls.

Thus, it is desirable to provide a releasable magnetic ski pole strap system that is able to overcome the above disadvantages and which enables a simpler, expedient, and strong releasable connection of a strap to a ski pole.

Advantages of the present invention will become more fully apparent from the detailed description of the invention hereinbelow.

SUMMARY OF THE INVENTION

Embodiments are directed to a releasable magnetic pole strap system including a pole which includes: a proximal end having a distal surface; and a pole attachment device connected to the distal surface of the proximal end of the pole. The system also includes a strap including a strap attachment device which is configured to be releasably attached to the pole attachment device. The distal surface of the proximal end of the pole is at least partially covered by the pole attachment device. Each of the pole attachment device and the strap attachment device includes either a magnet or a non-magnetic ferric material. At least one of the pole attachment device or the strap attachment device includes a magnet.

Embodiments are also directed to a releasable magnetic pole strap system including a pole attachment device configured to be connected to a distal surface of a proximal end of a pole. The system also includes a strap including a strap attachment device which is configured to be releasably attached to the pole attachment device. The distal surface of the proximal end of the pole is at least partially covered by the pole attachment device. Each of the pole attachment device and the strap attachment device comprises either a magnet or a non-magnetic ferric material. At least one of the pole attachment device or the strap attachment device comprises a magnet.

Additional embodiments and additional features of embodiments for the releasable magnetic pole strap system are described below and are hereby incorporated into this section.

BRIEF DESCRIPTION OF THE DRAWINGS

The foregoing summary, as well as the following detailed description, will be better understood when read in conjunction with the appended drawings. For the purpose of illustration only, there is shown in the drawings certain embodiments. It is understood, however, that the inventive concepts disclosed herein are not limited to the precise arrangements and instrumentalities shown in the figures. The detailed description will refer to the following drawings in which like numerals, where present, refer to like items.

FIG. 11 is a drawing illustrating a strap in the form of a gear tie. The figure depicts the magnet attached with a rivet placed through a loop created in one end of the gear tie;

FIG. 12 is a drawing illustrating a strap for a pole including a magnet positioned at (or near) a distal end of the strap;

FIG. 13 is a drawing illustrating a washer/magnet combination of the strap;

FIG. 19 is a drawing illustrating ferric plates attached to upper surfaces of skis; and FIG. 20 is a drawing illustrating poles releasably attached to the ferric plates shown in FIG. 19 via magnets of pole attachment devices.

DETAILED DESCRIPTION OF THE INVENTION

Figure 1:
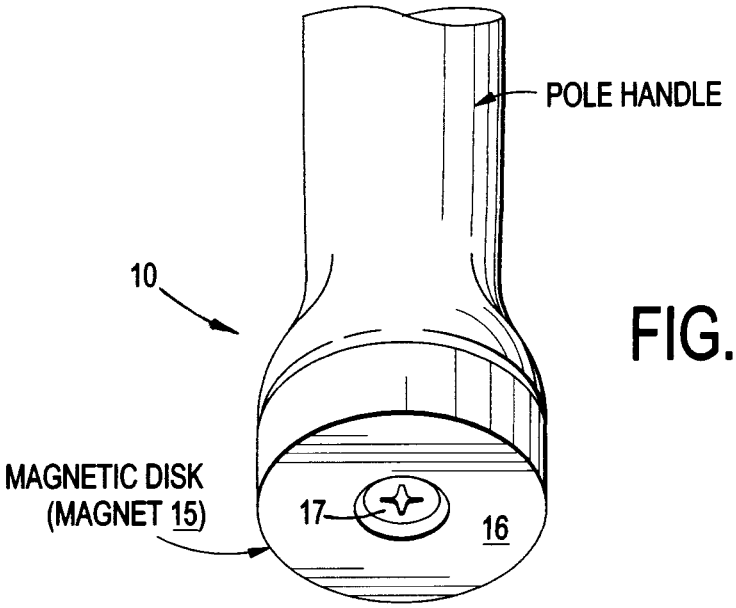
FIG. 1 is a drawing illustrating a magnet attached to the top of a pole with a countersunk screw.

It is to be understood that the figures and descriptions of the present invention may have been simplified to illustrate elements that are relevant for a clear understanding of the present invention, while eliminating, for purposes of clarity, other elements found in a typical releasable ski pole strap system. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

Before explaining at least one embodiment in detail, it should be understood that the inventive concepts set forth herein are not limited in their application to the construction details or component arrangements set forth in the following description or illustrated in the drawings. It should also be understood that the phraseology and terminology employed herein are merely for descriptive purposes and should not be considered limiting.

It should further be understood that any one of the described features may be used separately or in combination with other features. Other invented devices, systems, methods, features, and advantages will be or become apparent to one with skill in the art upon examining the drawings and the detailed description herein. It is intended that all such additional devices, systems, methods, features, and advantages be protected by the accompanying claims.

For purposes of this disclosure, the term "strap" is interchangeable with the terms tether, cable, string, tie, cord/cording, webbing, rope, band, and/or any combination thereof, and may be coiled or non-coiled.

For purposes of this disclosure, the term "glove" is interchangeable with the term "mitten".

FIG. 1 is a drawing illustrating a magnet 15 (having mating surface 16) attached to the top of a pole 10 with a countersunk screw 17.

Figure 2:
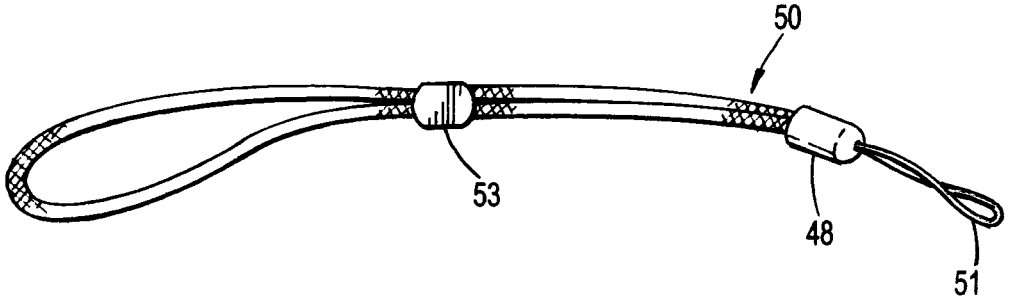
FIG. 2 is a drawing illustrating a strap for attaching a strap attachment device (e.g., magnet) thereto.

FIG. 2 is a drawing illustrating a strap 50 for attaching a strap attachment device (e.g., magnet) thereto.

Figure 3:
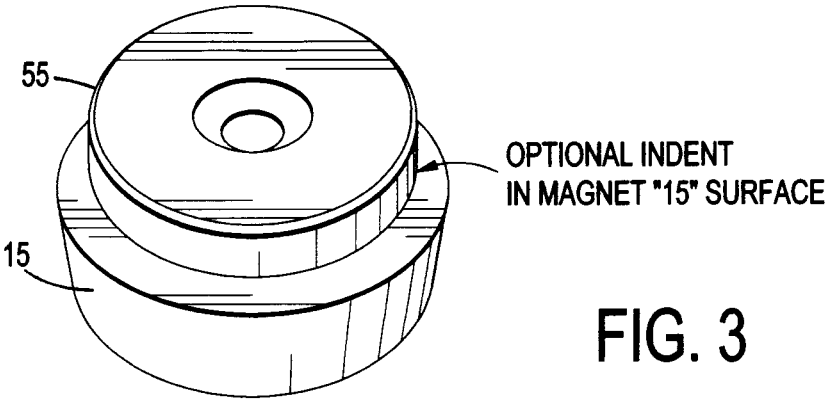
FIG. 3 is a drawing illustrating paired magnets (i.e., a pole attachment device paired with a strap attachment device)

FIG. 3 is a drawing illustrating paired magnets 15, 55 (i.e., a pole attachment device paired with a strap attachment device).

Figure 4:
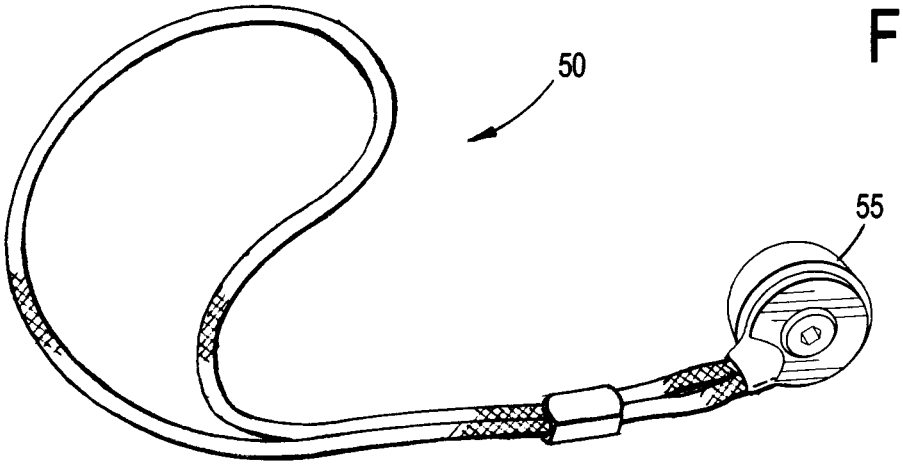
FIG. 4 is a drawing illustrating a strap including a strap attachment device (e.g., magnet)

FIG. 4 is a drawing illustrating a strap 50 including a strap attachment device (e.g., magnet 55).

Figure 5:
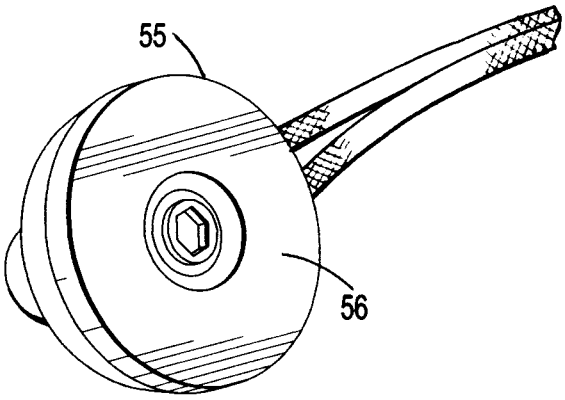
FIG. 5 is a drawing illustrating a mating surface of the magnet shown in FIG. 4.

FIG. 5 is a drawing illustrating a mating surface 56 of the magnet 55 shown in FIG. 4.

Figure 6:
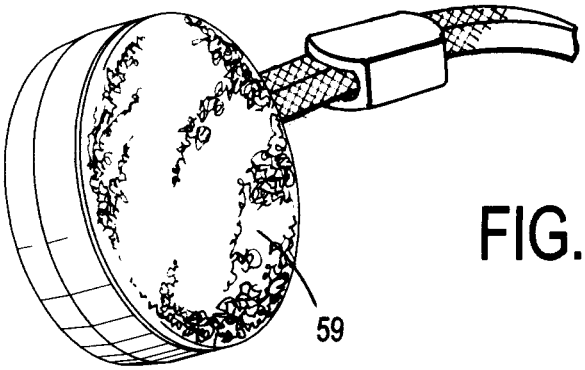
FIG. 6 is a drawing illustrating the mating surface of the magnet shown in FIG. 5 covered with a protective element including a scratch-preventive material.

FIG. 6 is a drawing illustrating the mating surface of the magnet shown in FIG. 5 covered with a protective element 59 including a scratch-preventive material.

Figure 7:
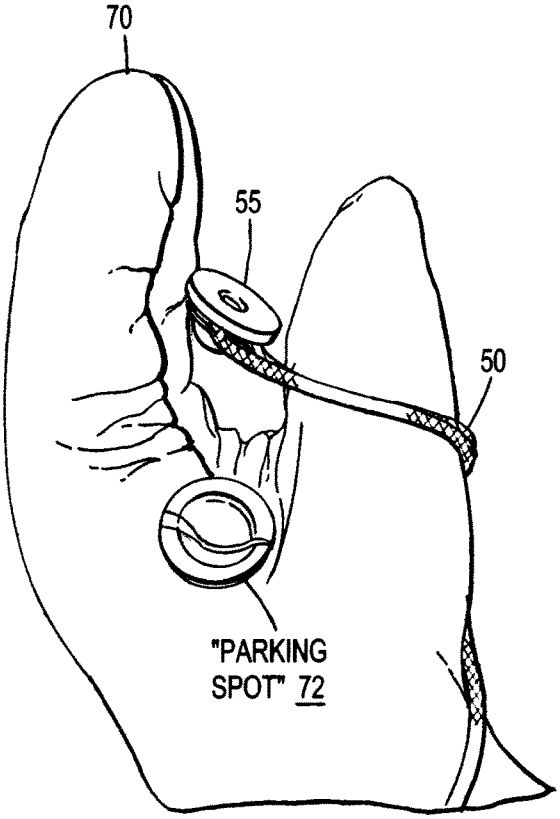
FIG. 7 is a drawing illustrating a glove including a glove magnet or glove non-magnetic ferric material affixed thereto which is configured to serve as a parking spot for the magnet of the strap attachment device. The figure depicts the parking spot without the magnet on it.

FIG. 7 is a drawing illustrating a glove 70 including a glove magnet 72 (or glove non-magnetic ferric material) affixed thereto which is configured to serve as a parking spot for the magnet 55 of the strap attachment device. The figure depicts the parking spot without the magnet 55 on it.

Figure 8:
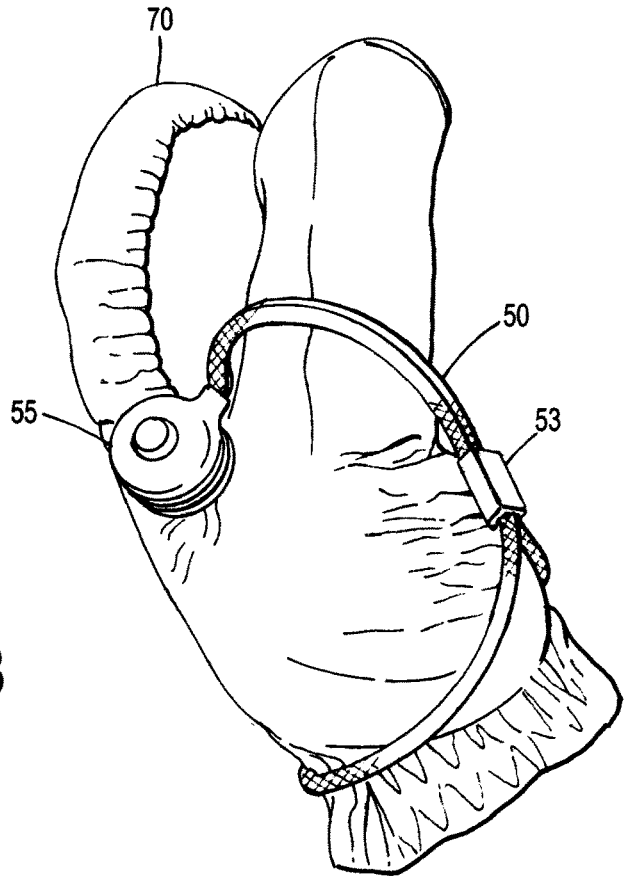
FIG. 8 is a drawing illustrating the glove shown in FIG. 7 depicting the parking spot with the magnet of the strap attachment device on it.

FIG. 8 is a drawing illustrating the glove 70 shown in FIG. 7 depicting the parking spot with the magnet 55 of the strap attachment device thereon and with the thumb passing through the distal part of the strap 50.

Figure 9:
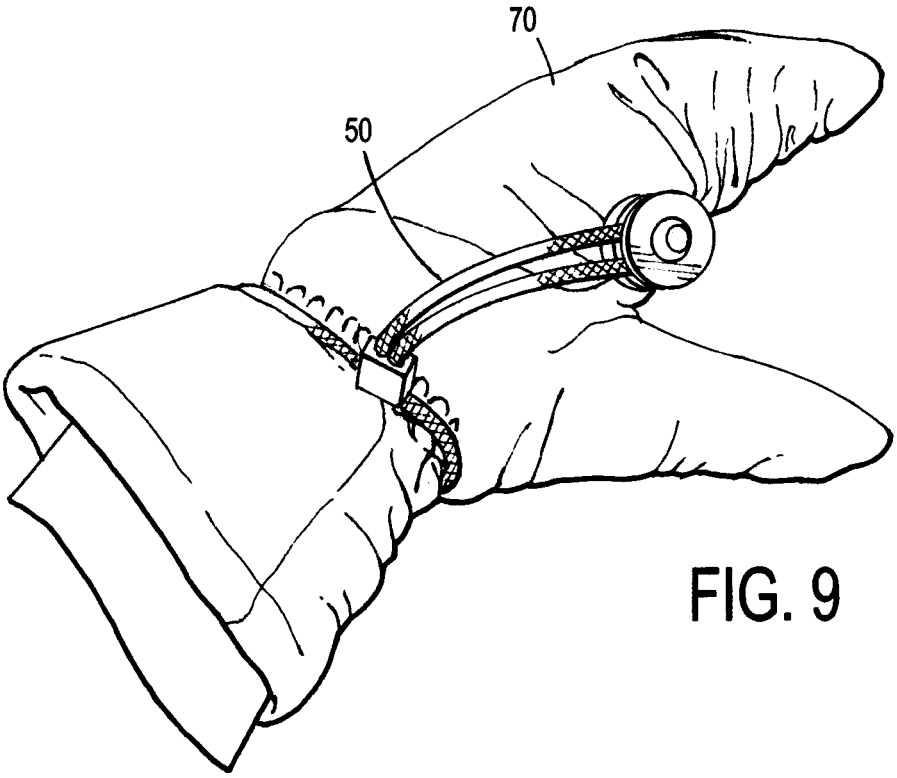
FIG. 9 is a drawing illustrating a glove using the strap shown in FIG. 4 with the strap attached around the wrist portion of the glove.

FIG. 9 is a drawing illustrating a glove 70 using the strap 50 shown in FIG. 4 with the strap 50 attached around the wrist portion of the glove 70.

Figure 10:
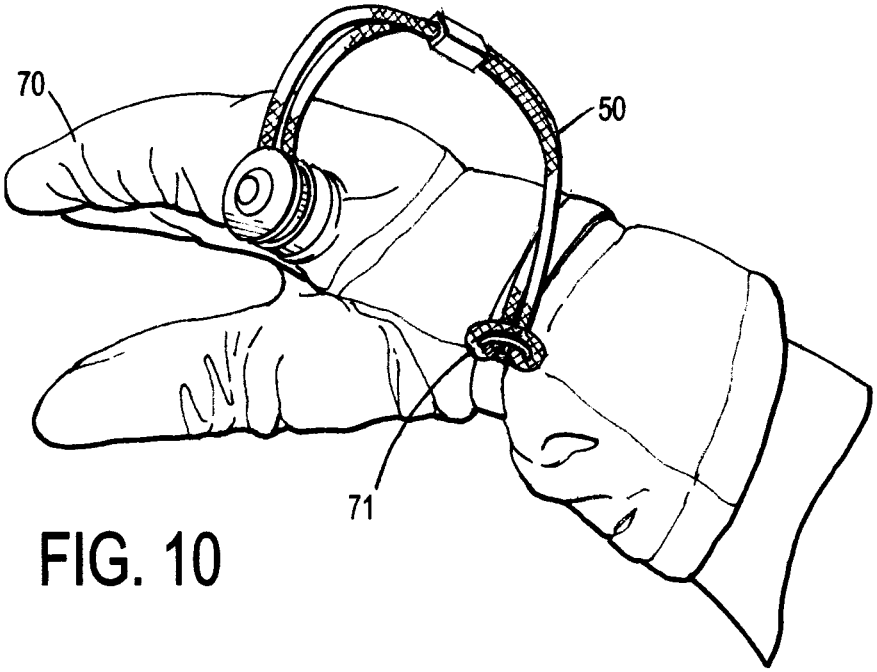
FIG. 10 is a drawing illustrating the glove shown in FIG. 9 with the strap attached to a clip of the glove.

FIG. 10 is a drawing illustrating the glove 70 shown in FIG. 9 with the strap 50 attached to a clip 71 of the glove 70.

FIG. 11 is a drawing illustrating a strap 1150 in the form of a gear tie. The figure depicts the magnet 55 attached with a rivet 57 placed through a loop 58 created in one end of the gear tie.

FIG. 12 is a drawing illustrating a strap 18 for a pole including a magnet 1215 positioned at (or near) a distal end of the strap 18.

FIG. 13 is a drawing illustrating a washer/magnet combination 1350 of the strap 50.

Figure 14:
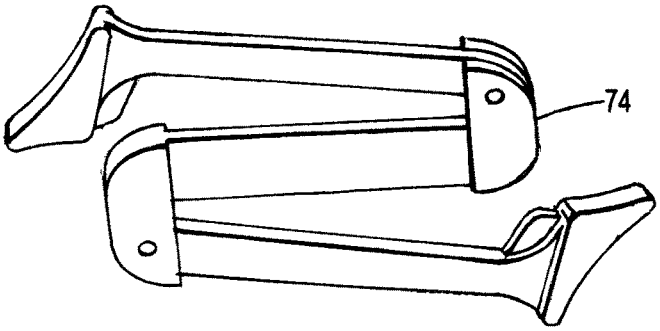
FIG. 14 is a drawing illustrating a webbing connecting clip for attaching a strap to a glove.

FIG. 14 is a drawing illustrating a webbing connecting clip 74 for attaching a strap 50 to a glove 70.

Figure 15:
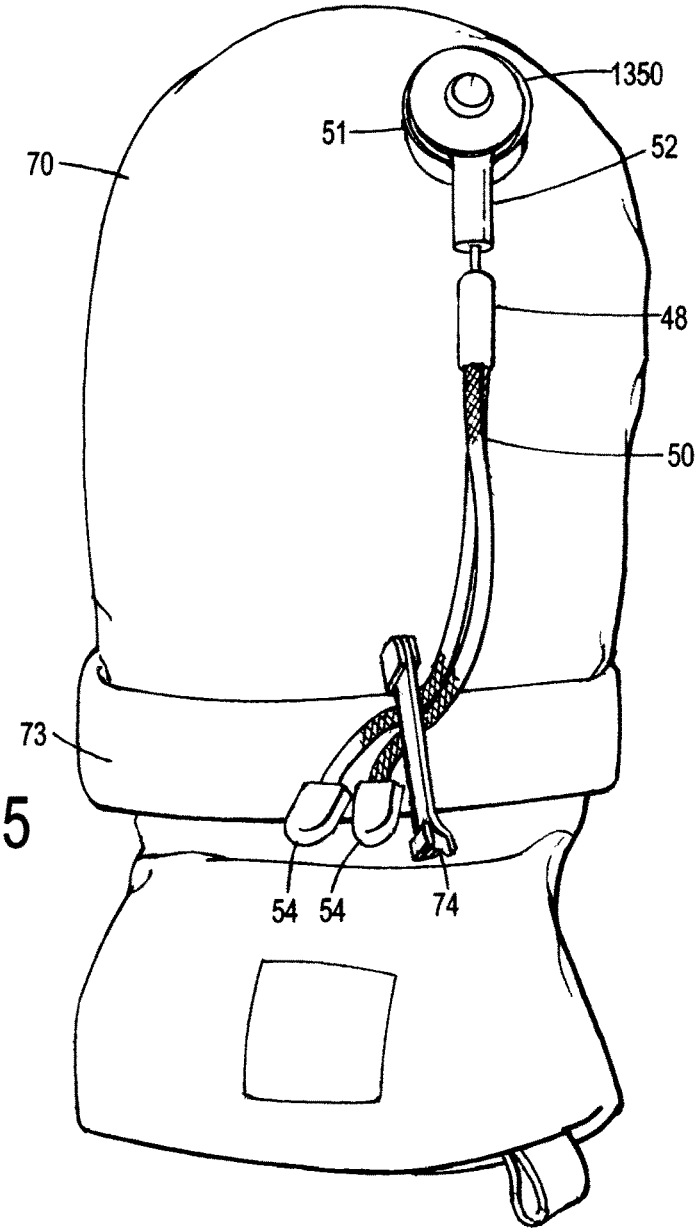
FIG. 15 is a drawing illustrating a strap connected to the webbing connecting clip shown in FIG. 14 which is, on its other side, connected to a tightening wrist strap on the glove.

FIG. 15 is a drawing illustrating a strap 50 connected to the webbing connecting clip 74 shown in FIG. 14 which is, on its other side, connected to a tightening wrist strap 73 on the glove 70. The tightening wrist strap 73 may or may not be initially provided with the glove 70

Figure 16:
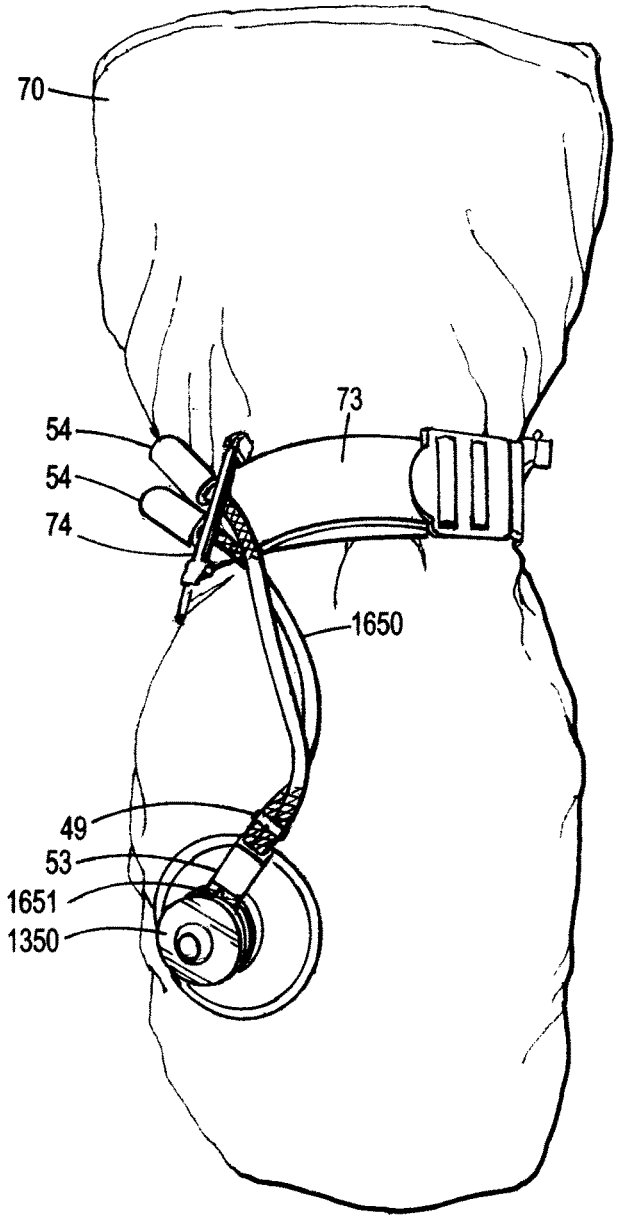
FIG. 16 is a drawing illustrating a strap including two proximal ends which are connected to the webbing connecting clip which is, on its other side, connected to the tightening wrist strap on the glove.
Figure 17:
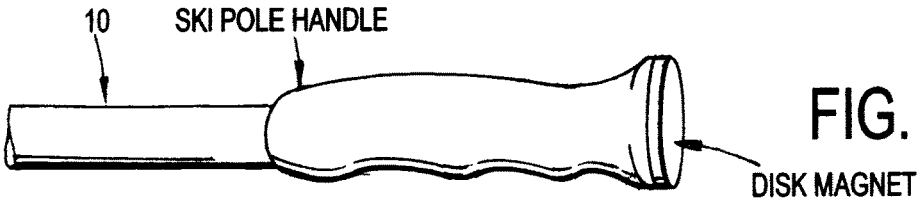
FIG. 17 is a drawing illustrating a magnet attached to the top of a pole with epoxy.

FIG. 16 is a drawing illustrating a strap 1650 including two proximal ends which are connected to the webbing connecting clip 74 which is, on its other side, connected to the tightening wrist strap 73 on the glove. The tightening wrist strap 73 may or may not be initially provided with the glove 70;

FIG. 17 is a drawing illustrating a magnet attached to the top of a pole 10 with epoxy.

Figure 18:
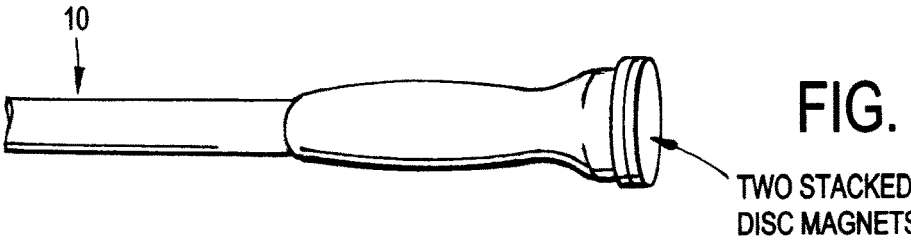
FIG. 18 is a drawing illustrating two magnets attached to the top of a pole.

FIG. 18 is a drawing illustrating two magnets attached to the top of a pole 10.

FIG. 19 is a drawing illustrating ferric plates 90 attached to upper surfaces of skis.

FIG. 20 is a drawing illustrating poles releasably attached to the ferric plates 90 shown in FIG. 19 via magnets 15 of pole attachment devices.

An embodiment of the invention uses strong mated (e.g., neodymium) magnets (which may be disk-shaped, ring-shaped, or another shape) to connect a strap 50 (which is attached semi-permanently to a ski glove or ski mitten) reversibly to a ski pole (in an embodiment, the magnet 15 is attached to the top of the pole 10). One magnet 15 may be attached to the top of the pole 10 with a countersunk screw 17 as shown in FIG. 1, and/or with a strong double-sided adhesive tape or epoxy (or other strong adhesive).

A neodymium disk magnet 15 which may be attached to the top of the pole 10 may be a K & J Magnetics part number RX436DCSPC-BLK (1.25" diameter, 20.49 lb. pull-force). A second neodymium disk magnet 55 that is attached, for example, to an 11" Pastall strap 50 (see FIG. 2 and FIG. 4) which is, in turn, attached to the glove or mitten, may be a K & J Magnetics part number RX034DCSPC-BLK (1" diameter, 9.56 lb. pull-force). The magnetic disks may be rubber coated to protect them from the elements and cracking as neodymium is somewhat brittle, and they are countersunk so that the mating surfaces are not blocked by attachment hardware. The paired magnets are shown in FIG. 3.

These disk magnets have countersunk holes on both sides so they can be attached to their respective elements in either magnetic orientation. That allows the magnetic orientation to be selected so that the magnets will attract one another. It should be apparent that magnets with a known magnetic orientation could have a countersunk hole on only one side.

It will be apparent to one skilled in the art that the force of magnetic attraction between the magnets can be altered by using different strength magnets or by placing materials between the magnets to physically separate them. In fact, one of the magnets could be replaced with a non-magnet ferric disk, like a steel washer. A range of force of magnetic attraction between the magnets may be, for example, 2 pounds to 75 pounds.

In an exemplary embodiment, the disk magnet that is attached to the pole is done so using a #10 countersunk screw and also an adhesive such as a double-sided adhesive tape or epoxy (or other strong adhesive). A screw that comes installed with the pole to attach the strap that comes with the pole may be suitable if it long enough to be countersunk with the magnet. The strap that comes with the pole may be removed as it is no longer needed. The other disk magnet is attached to the strap. The parts which have been used to perform this latter operation include a 3/16" diameter, ½" grip range Master Mechanics rivet, a rivet washer and the plastic end of the strap with a hole drilled through it to accommodate the rivet diameter. These parts are shown assembled in FIG. 4.

Note that the expanded distal end of the rivet fits completely within the countersunk hole on the mating surface 56 of the magnet 55 as shown in FIG. 5. That assures tight mating of the two magnets 15, 55. Then, a protective element 59 may optionally be placed over the mating surface 56 of the magnet 55 that is attached to the strap 50 as shown in FIG. 6. Such an element can also be used to purposely reduce the magnetic force, if so desired. This exemplary embodiment uses DFYOUHome 1" diameter loop disks for this purpose. That can offer protection if the magnet is attracted to a ferric surface, such as a car door or handle and minimize the potential for scratching. The lightweight, thin part of the strap, which is made of strong fiber (possibly nylon) has been removed as it serves no purpose in this configuration. In an alternate embodiment, the fibers may be used as a mechanism of attachment to a rivet or countersunk bolt. With reference to FIG. 7, to place the strap on the glove 70 or mitten, the proximal end of the strap 50 is placed around the glove 70, the adjustment slider (i.e., cinch 53, see FIG. 8) is cinched toward the glove 70 to make room for the thumb, which is optionally placed through the distal part of the strap 50. If the thumb is so placed, the magnet will sit in the groove between the thumb and first finger when not attached to the pole. The strap need not ever be removed from the glove or mitten. As shown, the proximal disk dangles slightly into the palm. If that is undesirable, the user can "park" the neodymium disk magnet on a (e.g., thin) ferric element 72, which can be much like a tie-tack or lapel pin, or another (e.g., disk) magnet. The ferric element 72 is shown without the magnet 55 on it in FIG. 7 and is shown with the magnet 55 parked on it in FIG. 8. There are alternate ways that the magnet 55 can be parked. For example, since the magnet may be protected with loop Velcro® (or equivalent hook-loop product) the magnet can be parked on hook Velcro® which is either glued and/or sewn to the glove.

Some individuals might find that their thumb slips out of the distal opening in the strap. That can be prevented by pinning the distal part of the strap to the glove. The pin can be of similar construction to a lapel pin or tie-tack and, for this purpose, need not be ferric.

Some individuals may prefer to not place the thumb through the distal opening. If so, the magnetic disk will dangle further and therefore be more likely to inadvertently jump to a nearby ferric surface. Use of the "parking spot" when not using the poles may be more important in such a case, as shown in FIG. 9. Other users may prefer to not attach the strap 50 around the wrist portion of the glove 70 or mitten, but rather attach it to an element that comes with the glove or mitten, such as a strap or clip 71 as shown in FIG. 10. That will also produce dangle and provide a reason to use the "parking spot." It will be apparent to one skilled in the art that a "parking spot" made of a ferric metal, hook Velcro® or a magnet could be incorporated into the glove or mitten during its manufacture. That suggests the possibility of creating a combination product consisting of: 1) a glove 70 with a built-in "parking spot"; 2) a tethered disk magnet 55; and 3) a preferably larger magnet 15, attached to the top of the ski pole by attaching it in the appropriate magnetic orientation with a screw and/or adhesive. This could also be sold as a kit which a skier could use to modify their existing poles and gloves, preferably after removing the strap that came with the poles, as it will no longer be needed and may get in the way or tangled.

When the proximal magnet is placed near the magnet on the pole, regardless of whether or not it is parked, it jumps onto the pole magnet with no user intervention required because the force of attraction of the pole magnet is significantly greater than that of the "parking spot."

An alternate embodiment of this invention is to attach the glove magnet to the thumb only. That can be done using a reusable tie strap such as the 8" long "One-Tie". A loop is formed for placement on the thumb and a magnet is attached to the end of the one tie. The magnet is attached with a cap-nut and countersunk bolt, but could also be riveted or attached in some other manner. It is first placed loosely on the thumb and then tightened to the degree desired by the user. A tether (in this case a mini-bungee) may be used to secure the One-Tie to the mitten in the event that the loop inadvertently falls off the thumb or a pin can be used to prevent it from falling off.

Another embodiment can be created using a rubber coated semi-stiff metal wire (as strap 1150) to connect the hand magnet 55 to the glove 70 or mitten, such as the Nite-Ize Gear Tie (i.e., strap 1150). The magnet 55 may be attached with a rivet 57 placed through a loop 58 created in one end of the gear tie 1150 as shown in FIG. 11. The loop 58 is secured using a mini-cable tie.

The proximal end of the strap 1150 can easily be attached to hardware or straps on the glove or mitten by passing it through the attachment site and twisting it back on itself.

The neodymium magnets are very strong and "jump" to nearby ferric surfaces. Therefore, it may be desirable to provide a ferric cap to blunt the magnetic force or a soft, thick sock-like structure to place over the magnets when not in use.

In yet another embodiment, the mating of the magnets could take place on the glove 70, rather than on the poles 10. In this case, straps 18 would be attached to the poles and would have a magnet 1215 at the end of the strap 18 furthest from the pole as shown in FIG. 12. The magnet 1215 could then mate with a magnet or other ferric surface that is permanently (or semi-permanently) attached to the glove 70. A possible disadvantage of this embodiment is that the dangling magnet 1215 might "jump" to the chairlift or other ferric surface, so to prevent this, a ferric or magnetic parking spot would be employed on the pole.

It will be apparent to one skilled in the art that variations of this device and method can be used. For example, the magnetic connection can be replaced with a mechanical connection that is passively activated and released when a given pull force (which might be adjustable with a tensioning screw/release) is exceeded. That configuration requires the user to forcefully insert a pin with a widened end to pass through a resistive force such as via, for example, springs which hold it in place until a desired force is exceeded. An additional mechanism to easily remove the pin, such as loosening the tensioning screw, could be employed. For example, the tensioning screw could be replaced with a lever with two (or more) positions including set and release.

Also, embodiments herein are described using straps with a cylindrical cross-section. However, as one skilled in the art will appreciate, straps of other configurations, shapes, and sizes could alternatively be employed and alternate mechanisms of attachment of the straps to the magnets could be employed.

Embodiments herein provide a releasable mechanism to attach a ski pole strap to a ski pole. The poles will release in a hard fall and will stay with the skier in a light fall. There is no incorrect way to put on the poles; there is no right or left pole and no need to place the strap on in any particular direction. The straps allow a skier to apply downward force from the base of the thumb, which allows skiers to accelerate in a familiar and conventional manner on flat or slightly uphill terrain. When magnets are used, the straps attach to the pole essentially instantaneously as the magnets are brought near one another and are easily separated by the skier with a manual push and with no need to push a release button. That is particularly useful for skiers getting on or off a chair lift and a valuable safety feature in the event of a hard fall, in particular when there is a pole trapped in tree branches or other objects. That could prevent a hyperextension injury which could result in a rotator cuff tear or skier's thumb. If the mated magnets reside on the pole, a "parking spot" may optionally be provided to store the proximal magnet on the glove and prevent it from dangling. A benefit of having the magnets on the poles is that they usually can be parked securely on the chair lift, usually above the skier, if there is a suitable flat ferric surface to attach them to. Yet another benefit is that a glove or gloves can be removed from the hands and stored on the poles while riding the chair lift as many skiers like to use their cell phones while riding the chairlift.

An alternate embodiment for attaching the straps to the magnets is described herein. A strap as shown in FIG. 2 is used. A washer/magnet combination 1350 of the strap 50 includes a parallel pair of 1" diameter washers 60 attached to the top of a 1" diameter countersunk coated neodymium magnet 55 with a rivet and appropriate 3/16 # inner diameter washers, two of which are used to place the parallel 1" washers 60 about ¾" apart and two of which are used to position the rivet so that the expanded part of the pop-rivet is contained within the bottom countersunk hole. The filament 51 is positioned within the space 61 between the washers 60. The completed washer/magnet combination 1350 is shown in FIG. 13. The filament 51 is then attached between the washers and around a spacer positioned between the washers 60 within the space 61 after the filament 51 is passed through a short rubber tube 52 (see FIG. 15) so that the strap, after the filament 51 is stretched to pass between the washers 60, will not fall off. A bolt, rivet or other fastener may run centrally through the washer/magnet combination 1350 to keep the elements therein fastened together. The finished strap/magnet combination is shown in FIG. 15. The advantage of this arrangement is that the strap 50 can swing freely around the magnet 55 so that the user can line up their fingers with the finger indentations commonly found in the ski pole handle without having to reposition the magnet that is attached to the strap.

Another embodiment relates to the parking spot for the magnet. We have discovered a Velcro®-like material, Stay Gent strips, that is backed with a fabric adhesive which adheres well to the glove in normal or cold temperatures and can be removed cleanly by heating. The magnets are attached (using, for example, two ¾" uncoated neodymium magnets for this purpose under the adhesive of the loop Velcro) and then a hook Velcro decorative patch (which might contain a logo) may be optionally applied onto the loop Velcro which adheres to the glove.

Some additional improvements are described here. A webbing connecting clip 74 as shown in FIG. 14 may be employed to attach the strap 50 to the glove 70 if the ski glove has a wrist strap 73 (either provided initially with the glove or as an addition to the glove). A wrist strap cinch or other fastener (not shown) is typically provided on or attached to the wrist strap 73 to tighten the wrist portion of the glove. A wrist strap that is part of a glove or mitten, as shown in FIG. 16, allows the skier to attach the strap 50 to the clip 74 without having to put another wrist strap 73 around the glove such as that shown in FIG. 15 and provides an attachment point in gloves that do not initially have a clip 71 (see FIG. 10), such as the mitten shown in FIG. 15. Furthermore, there is a Velcro®-type backed fabric adhesive "Stay Gent Strips" which remains adherent to gloves in cold or neutral temperature and which can be removed cleanly with the application of heat and then cleaning up any residue with acetone or other glue remover. The Stay Gent Strips come with both Velcro®-type hook and Velcro®-type loop fastener surfaces. The inventors have found that they can use these strips to adhere magnets (we use two ¾' neodymium magnets) to the glove or mitten by placing the magnets in the middle of loop strips and then gluing them down, and then they can attach an attractive hook-backed Velcro-type patch or logo to the Stay Gent strip.

It should be apparent to one skilled in the art that an iron-on patch can be used instead of the Stay Gent-Velcro®-like hook patch/logo combination.

With respect to the FIG. 15 embodiment, the following is a description of how the proximal end of the strap-magnet combination is made and then attached to the glove. An end of the loop is cut and the cinch 53 is removed. Plastic element 48 shown in FIG. 2 and FIG. 15 is left on and it secures the filament 51 to the rest of the strap 50). Rubber tube 52 surrounds the filament 51 (see FIG. 15) and keeps the filament 51 snug around the spacer positioned between the washers within the space 61 so that the strap 50 will not fall off. Note that rope end clips 54, such as HJ Zip Clips Rope Buckle Cord End Stoppers, may be employed. Those end clips 54 serve two purposes: 1) they prevent the end of the strap ropes from fraying; and 2) they prevent the proximal end of the strap from slipping through the webbing clip. The end clips 54 are attached to the ends of the cut strap and attached to the upper side of the webbing connecting clip 74 (shown in FIG. 15 and FIG. 16). The straps can then be attached to the wrist strap 73 on the glove 70 with the lower side of the webbing connecting clip 74.

As the filament 51 (FIG. 2) may not be as strong as the strap 50, an alternate and more preferred embodiment is illustrated in FIG. 16 that uses the strap 1650 itself (instead of the filament 51) to attach around a spacer positioned between the washers 60 within the space 61. The filament 51, rubber tube 52, and plastic element 48 are omitted as they are not needed in the FIG. 16 embodiment. The strap 1650 is cut so that end snaps 54 can be placed on ends of the two cut strap elements. The end snaps 54 keep the two cut strap elements from fraying and keep the two cut strap elements from slipping out of the webbing connector clip 74 since the end snaps 54 are larger than the slit/opening in the corresponding side of the webbing connector clip 74. The proximal parts of the strap 1650 (i.e., the two cut strap elements) are passed through and locked to the upper side of the webbing connector clip 74. The distal part of the strap 1650 (a loop 1651) is positioned between the parallel washers 60 of the washer/magnet combination 1350 and surround a spacer positioned between the washers 60 within the space 61. A cinch 53 (see also FIG. 2) may be employed to secure the position of the magnet at the end of the strap 1650. More specifically, the loop 1651 is positioned at an end of the strap 1650 facing the magnet (i.e., the washer/magnet combination 1350). The cinch 53 cinches an end portion of the strap 1650 and secures the position of the magnet within the loop 1651. An optional cable tie 49 may also be employed at or near the cinch 53 to keep the cinch 53 from sliding once the cinch 53 is in a desired position.

In another alternative embodiment, when gloves 70 do not have their own tightening wrist straps 73 to attach to the webbing connector clip 74, the skier may choose to attach the proximal ends of the straps 1650 to other preexisting hardware (e.g., fasteners, clips, etc.) on the glove 70.

An alternate way of attaching the magnet to the ski pole handle is by epoxying it. FIG. 17 shows a magnet epoxied (or another adhesive may alternatively be employed) to the top of a ski pole handle. Of course, one can use both a countersunk screw and epoxy for a very secure attachment.

Also, the strength of the attachment between the magnet on the pole and the magnet on the strap can be adjusted by stacking multiple magnets. FIG. 18 shows two disk magnets stacked and thus will hold the glove to the pole with greater force than a single magnet. A more experienced, aggressive skier may choose to use a stronger attachment setting by using multiple stacked magnets as they may want the pole to come off only in a very hard fall. The additional magnets can be stacked via magnetic force alone or using epoxy or other fastening mechanism, for a semi-permanent or permanent fixation.

In any of the embodiments above, when skiing and when the magnets 15, 55 are attached to each other, the skier may apply force downward and perpendicular to the mating surfaces of the magnets 15, 55, for poling on flat or slightly uphill terrain.

As most skiers know, when the snow is packed very hard, it can be difficult to store your poles by stabbing them into the snow while getting your boots on or off your skis. An additional benefit of the magnets 15 on the top of the ski poles is that they may provide an alternate convenient location to store the poles. That is done by placing a magnetic or a ferric plate 90 on each ski as shown in FIG. 19 The holes in the plates 90 are not necessary. Then the poles may be stored temporarily by turning them upside down and attaching them to the plates 90 as shown in FIG. 20.

Embodiments are directed to a releasable magnetic pole strap system including a pole which includes: a proximal end having a distal surface; and a pole attachment device connected to the distal surface of the proximal end of the pole. The system also includes a strap including a strap attachment device which is configured to be releasably attached to the pole attachment device. The distal surface of the proximal end of the pole is at least partially covered by the pole attachment device. Each of the pole attachment device and the strap attachment device includes either a magnet or a non-magnetic ferric material. At least one of the pole attachment device or the strap attachment device includes a magnet.

In an embodiment, the strap attachment device is configured to be releasably attached to the pole attachment device via any approach angle when the strap attachment device approaches the pole attachment device.

In an embodiment, the strap attachment device is configured to be releasable from the pole attachment device via use of a force greater than, for example, 2-75 pounds applied between the strap attachment device and the pole attachment device.

In an embodiment, the strap attachment device is configured to be releasable from the pole attachment device via use of a force separating the strap attachment device from the pole attachment device in any direction away from the pole attachment device.

In an embodiment, the strap attachment device is configured to be releasable from the pole attachment device without use of a trigger, switch, or other mechanical device.

In an embodiment, the strap attachment device comprises a magnet, and the strap further includes: a loop positioned at an end of the strap facing the magnet; a cinch that cinches an end portion of the strap and secures the position of the magnet within the loop; a first washer; a second washer; a spacer provided between the first washer and the second washer; and a fastener that extends through the first washer, the spacer, and the second washer, while the spacer is positioned between the first washer and the second washer. The first washer includes a first side and an opposite second side, wherein the first side faces the magnet and the second side faces the second washer which is spaced from the first washer via the spacer to form a space between the first washer and the second washer, wherein the loop is loosely secured to and surrounds the spacer and is positioned at least partly within the space such that the strap can swing 360 degrees around the spacer via the loop, and wherein the cinch keeps the loop snug around the spacer.

In an embodiment, each of the pole attachment device and the strap attachment device includes a magnet.

In an embodiment, the magnet is in a shape of a ring or disk. In one embodiment, the magnet includes an outer diameter of, for example, 0.8-2.0 inches. In another embodiment, the magnet includes neodymium. In a further embodiment, the magnet includes at least two stacked magnets.

In an embodiment, the distal surface of the proximal end of the pole is entirely covered by the pole attachment device.

In an embodiment, the pole attachment device includes a pole attachment device mating surface configured to mate with a strap attachment device mating surface of the strap attachment device. At least one of the pole attachment device mating surface or the strap attachment device mating surface may include a scratch-preventive material applied thereon.

In an embodiment, the pole attachment device includes a pole attachment device mating surface configured to mate with a strap attachment device mating surface of the strap attachment device. With reference to FIG. 3, either the pole attachment device mating surface includes an indentation configured to store at least a portion of the strap attachment device, or the strap attachment device mating surface includes an indentation configured to store at least a portion of the pole attachment device, when the strap attachment device is attached to the pole attachment device. In an example, the indent/indentation in the magnet 15's surface is optional and would have the magnet 55 sit partially within the indent when the magnets are attached. This configuration would aid and maintain the positioning of the two magnets relative to each other during the attaching step of the magnets to each other, and could aid in preventing slippage of the magnets relative to each other during application of force while skiing or during a less intense (non-serious) fall.

In an embodiment, the pole further includes a hand grip. The hand grip includes the proximal end of the pole.

In an embodiment, the pole attachment device is connected to the distal surface of the proximal end of the pole via a countersunk screw.

In an embodiment, the system further includes a glove. The strap is configured to be attached to the glove, whereby a user of the system is capable of holding the pole via wearing the glove while the strap attachment device is releasably attached to the pole attachment device. In one embodiment, the strap attachment device includes a magnet. The glove includes a glove magnet or glove non-magnetic ferric material affixed thereto which is configured to serve as a parking spot for the magnet of the strap attachment device when the strap attachment device is not attached to the pole attachment device. In another embodiment, the strap is configured to be attached to the glove via another strap or a clip affixed to the glove.

In an embodiment, the pole includes a ski pole. In one embodiment, the pole attachment device includes a magnet, and the system further includes a ski having a ferric plate affixed thereon, whereby the pole attachment device is configured to be releasably attached to the ferric plate when the strap attachment device is not attached to the pole attachment device.

Embodiments are also directed to a releasable magnetic pole strap system including a pole attachment device configured to be connected to a distal surface of a proximal end of a pole. The system also includes a strap including a strap attachment device which is configured to be releasably attached to the pole attachment device. The distal surface of the proximal end of the pole is at least partially covered by the pole attachment device. Each of the pole attachment device and the strap attachment device comprises either a magnet or a non-magnetic ferric material. At least one of the pole attachment device or the strap attachment device comprises a magnet.

Although embodiments are described above with reference to a ski pole, the ski pole described in any of the above embodiments may alternatively be another type of pole such as a walking pole, hiking pole, cane, umbrella pole, etc. Such alternatives are considered to be within the spirit and scope of the present invention, and may therefore utilize the advantages of the configurations and embodiments described above.

The method steps in any of the embodiments described herein are not restricted to being performed in any particular order. Also, structures or systems mentioned in any of the method embodiments may utilize structures or systems mentioned in any of the device/system embodiments. Such structures or systems may be described in detail with respect to the device/system embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A releasable magnetic pole strap system comprising:

a pole comprising:

a longitudinal axis;

a proximal end having a hand grip and a distal surface; and a pole attachment device at the distal surface of the proximal end of the pole, the pole attachment device comprising a magnet; and a strap comprising a proximal end, a distal free end opposite the proximal end, and a strap attachment device located on the strap at or near the distal free end thereof, the strap attachment device being configured to be releasably attached to the pole attachment device, and the strap attachment device comprising either a magnet or a non-magnetic ferric material, wherein the distal surface of the proximal end of the pole is at least partially covered by the pole attachment device, and wherein the pole and strap attachment devices are positioned to allow the strap attachment device to release from the pole attachment device in any direction away from the pole attachment device including in a lateral direction with respect to the longitudinal axis of the pole.

2. The system of claim 1, wherein the strap attachment device is configured to be releasably attached to the pole attachment device via any approach angle when the strap attachment device approaches the pole attachment device.

3. The system of claim 1, wherein the strap attachment device is configured to be releasable from the pole attachment device via use of a force applied between the strap attachment device and the pole attachment device.

4. The system of claim 1, wherein the strap attachment device is configured to be releasable from the pole attachment device via use of a force separating the strap attachment device from the pole attachment device in any direction away from the pole attachment device.

5. The system of claim 1, wherein the strap attachment device is configured to be releasable from the pole attachment device without use of a trigger, switch, or other mechanical device.

6. The system of claim 1, wherein the strap attachment device comprises a magnet, and wherein the strap further comprises:

a filament positioned at the distal free end of the strap facing the magnet;

a rubber tube that surrounds the filament;

a first washer;

a second washer;

a spacer provided between the first washer and the second washer; and a fastener that extends through the first washer, the spacer, and the second washer, while the spacer is positioned between the first washer and the second washer;

wherein the first washer comprises a first side and an opposite second side, wherein the first side faces the magnet and the second side faces the second washer which is spaced from the first washer via the spacer to form a space between the first washer and the second washer, wherein the filament is loosely secured to and surrounds the spacer and is positioned at least partly within the space such that the strap can swing 360 degrees around the spacer via the filament, and wherein the rubber tube keeps the filament snug around the spacer.

7. The system of claim 1, wherein the strap attachment device comprises a magnet, and wherein the strap further comprises:

a loop positioned at the distal free end of the strap facing the magnet;

a cinch that cinches an end portion of the strap and secures the position of the magnet within the loop;

a first washer;

a second washer;

a spacer provided between the first washer and the second washer; and a fastener that extends through the first washer, the spacer, and the second washer, while the spacer is positioned between the first washer and the second washer;

wherein the first washer comprises a first side and an opposite second side, wherein the first side faces the magnet and the second side faces the second washer which is spaced from the first washer via the spacer to form a space between the first washer and the second washer, wherein the loop is loosely secured to and surrounds the spacer and is positioned at least partly within the space such that the strap can swing 360 degrees around the spacer via the loop, and wherein the cinch keeps the loop snug around the spacer.

8. The system of claim 1, wherein the strap attachment device comprises a magnet.

9. The system of claim 1, wherein the magnet is in a shape of a ring or disk.

10. The system of claim 9, wherein the magnet comprises neodymium.

11. The system of claim 9, wherein the magnet comprises at least two stacked magnets.

12. The system of claim 1, wherein the distal surface of the proximal end of the pole is entirely covered by the pole attachment device.

13. The system of claim 1, wherein the pole attachment device comprises a pole attachment device mating surface configured to mate with a strap attachment device mating surface of the strap attachment device, and wherein at least one of the pole attachment device mating surface or the strap attachment device mating surface comprises a scratch-preventive material applied thereon.

14. The system of claim 1, wherein the pole attachment device comprises a pole attachment device mating surface configured to mate with a strap attachment device mating surface of the strap attachment device, and wherein either the pole attachment device mating surface comprises an indentation configured to store at least a portion of the strap attachment device, or the strap attachment device mating surface comprises an indentation configured to store at least a portion of the pole attachment device, when the strap attachment device is attached to the pole attachment device.

15. The system of claim 1, wherein the pole further comprises a hand grip, and wherein the hand grip comprises the proximal end of the pole.

16. The system of claim 1, wherein the pole attachment device is connected to the distal surface of the proximal end of the pole via a countersunk screw.

17. The system of claim 1 further comprising a glove, wherein the strap is configured to be attached to the glove, whereby a user of the system is capable of holding the pole via wearing the glove while the strap attachment device is releasably attached to the pole attachment device.

18. The system of claim 17, wherein the strap attachment device comprises a magnet, and wherein the glove comprises a glove magnet or glove non-magnetic ferric material affixed thereto which is configured to serve as a parking spot for the magnet of the strap attachment device when the strap attachment device is not attached to the pole attachment device.

19. The system of claim 17, wherein the strap is configured to be attached to the glove via a webbing connector clip connected to a wrist strap which is affixed to the glove.

20. The system of claim 1, wherein the system further comprises a ski having a ferric plate affixed thereon, whereby the pole attachment device is configured to be releasably attached to the ferric plate when the strap attachment device is not attached to the pole attachment device.

21. A releasable magnetic pole strap system comprising:

a pole attachment device configured to be connected to a distal surface of a proximal end of a pole, the pole attachment device comprising a magnet; and a strap comprising a proximal end, a distal free end opposite the proximal end, and a strap attachment device located on the strap at or near the distal free end thereof, the strap attachment device being configured to be releasably attached to the pole attachment device, and the strap attachment device comprising a magnet or a non-magnetic ferric material, wherein the distal surface of the proximal end of the pole is at least partially covered by the pole attachment device, and wherein the pole and strap attachment devices are positioned to allow the strap attachment device to release from the pole attachment device in any direction away from the pole attachment device including in a lateral direction with respect to the longitudinal axis of the pole, wherein the magnet of the pole attachment device is larger in size and stronger in force of attraction than the magnet or non-magnetic ferric material of the strap attachment device.

22. A releasable magnetic pole strap system, comprising:

a pole attachment device configured to be connected to a proximal end of a pole, the pole attachment device being at least one magnet; and a strap separate from the pole, the strap comprising a proximal end, a distal free end opposite the proximal end, and a strap attachment device located on the strap at or near the free end thereof, the strap attachment device being at least one magnet configured to releasably attach to the at least one magnet of the pole attachment device;

wherein the proximal end of the strap engages a glove, whereby the free end of the strap can dangle from the glove, and wherein the pole attachment device has a stronger force of attraction than the strap attachment device.

23. The system of claim 22, wherein the force of attraction of the pole attachment device is at least twice as strong as the force of attraction of the strap attachment device.

24. The system of claim 22, wherein the at least one magnet of the pole attachment device has a diameter that is larger than a diameter of the strap attachment device.

* * * * *